US005172175A

United States Patent [19]

Sekino et al.

[11] Patent Number: 5,172,175

[45] Date of Patent: Dec. 15, 1992

[54] IMAGE FORMING DEVICE FOR PRESSURE-CONTACTING AN ENDLESS BELT ON AN IMAGE CARRIER FOR IMAGE TRANSFERRING

[75] Inventors: Hitoshi Sekino; Hiroaki Kojima; Yasuhiro Matsuura; Keizo Nishiguchi; Kazuo Matsuura, all of Osaka, Japan

[73] Assignee: Minolta Camera Kabushiki Kaisha, Osaka, Japan

[21] Appl. No.: 453,681

[22] Filed: Dec. 20, 1989

[30] Foreign Application Priority Data

Dec. 23, 1988 [JP] Japan ..... 63-326436

[51] Int. Cl.[5] ..... G03G 15/01

[52] U.S. Cl. ..... 355/277; 355/272; 355/326

[58] Field of Search ..... 355/277, 278, 279, 280, 355/281, 200, 271, 274, 275, 326, 327, 272

[56] References Cited

U.S. PATENT DOCUMENTS

| | | | |
|---|---|---|---|
| 2,408,143 | 9/1946 | Huebner | 355/326 X |
| 2,626,865 | 1/1953 | Mayo et al. | 355/274 X |
| 4,162,843 | 7/1979 | Inoue et al. | 355/274 X |
| 4,515,460 | 5/1985 | Knechtel | 355/271 X |
| 4,531,828 | 7/1985 | Hoshino | 355/327 X |

FOREIGN PATENT DOCUMENTS

| | | | |
|---|---|---|---|
| 0307942 | 3/1989 | European Pat. Off. | 355/211 |
| 0014662 | 1/1987 | Japan | 355/271 |
| 63-68869 | 3/1988 | Japan . | |
| 63-122364 | 8/1988 | Japan . | |

*Primary Examiner*—A. T. Grimley
*Assistant Examiner*—T. A. Dang
*Attorney, Agent, or Firm*—Willian, Brinks, Olds, Hofer, Gilson & Lione

[57] ABSTRACT

An image forming device has a rotating image carrier for carrying an image and a transfer unit including a plurality of rotating rollers, an endless belt travelling around the rollers, and a supporting member for supporting the rollers in such a manner that distances between the rollers be kept constant. At least one of the rollers is a pressure-contacting roller opposed to the image carrier with the endless belt therebetween. The device further has a pressure-contacting unit for energizing the transfer unit in a direction that the pressure-contacting roller be pressure-contacted on the image carrier with the endless belt therebetween.

14 Claims, 5 Drawing Sheets

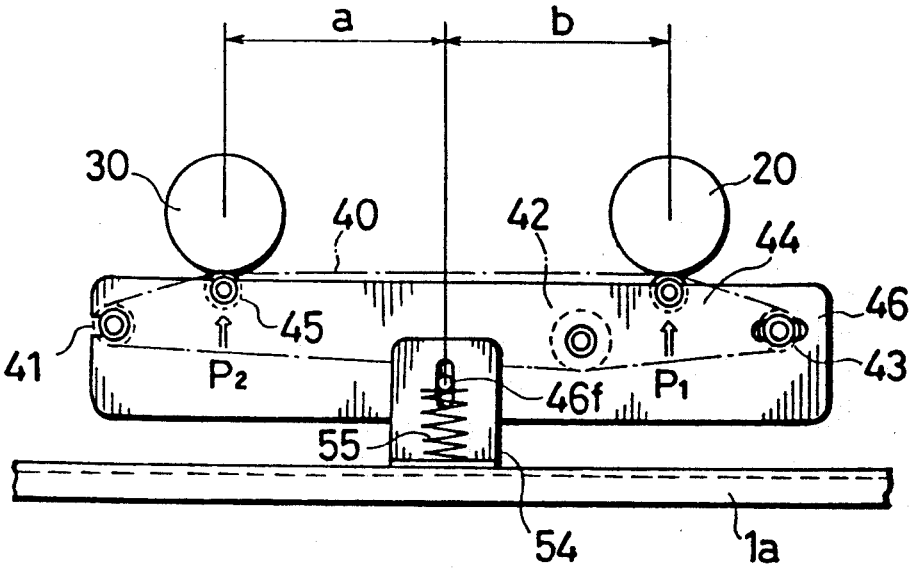
a
b
30
20
40
42
44
45
46
41
43
P2
P1
46f
55
54
1a

IMAGE FORMING DEVICE FOR PRESSURE-CONTACTING AN ENDLESS BELT ON AN IMAGE CARRIER FOR IMAGE TRANSFERRING

BACKGROUND OF THE INVENTION (1) Field of the Invention

This invention relates to an image forming device for transferring a toner carried by a toner carrier like a photoconductive drum onto a paper supported and transported by a transfer belt or directly onto the transfer belt.

(2) Description of the Related Art

There has been a conventional image forming device for pressure-contacting an endless belt on an image carrier for the purpose of image transferring. For example, in order to obtain a two-color image, two photoconductive drums are provided and the transfer belt is pressure-contacted on these photoconductive drums, whereby a toner image formed on the first drum in a first color is transferred onto a paper which has been transported on the transfer belt and then another toner image formed on the second drum in a second color is transferred onto the above paper.

Such device has a construction as shown in FIG. 1 wherein a transfer belt 102 travels around while being pressure-contacted on photoconductive drums 100 and 101 (only 100 is shown in the figure) by two pressure-contacting rollers 103 and 104 (only 103 is shown). The pressure-contacting roller 103 is rotatably supported at both ends thereof by a pair of bearings 103*b* (only one is shown in the figure). Each bearing 103*b* is independently energized upward by a spring 105. Since the pressure-contacting roller 104 has the same construction, four springs are provided in all. The pressure-contacting forces between the photoconductive drums 100 and 101 and the rollers 103 and 104 are respectively adjusted by changing the forces of these four springs.

Adjusting a pressure-contacting force so that the transfer belt 102 may be pressure-contacted on the photoconductive drums 100 and 101 is quite important to improve transferring efficiency and obtain a clear image.

Japanese Patent Publication Kokai No. 60-2542167 discloses another example of the conventional image forming devices for getting a two-color image. This is characterized in that the images on two photoconductive drums are transferred directly on the transfer belt.

However, the above-mentioned method of adjusting the pressure-contacting force has the following problems 1), 2), 3), and 4) which restricts the possibility of improving the transferring efficiency and clearness of the images.

1) The pressure-contacting force between the transfer belt and the photoconductive drum and the tension of the transfer belt are usually adjusted after the transfer belt is separated from the photoconductive drum. Accordingly, the adjusted force of the spring and position of the pressure-contacting roller are different from those when the device is in use, namely when the transfer belt is pressure-contacted on the photoconductive drum.

More practically, when the device is in use, the spring is contracted to increase its energizing force and the pressure-contacting roller is moved in a direction to press down the transfer belt to decrease the tension of the belt.

Furthermore, the differences in the energizing force and in the position of the roller between when the device is in use and when the device is in adjustment is varied depending on each device because the position of the photoconductive drum or the like depends on each device.

In consequence, it is extremely difficult to adjust the pressure-contacting force of the transfer belt on the photoconductive drum and the tension of the belt so that they may be most appropriate when the belt is pressure-contacted on the drum, using the above adjusting method.

If the pressure-contacting force of the belt on the drum is not appropriate, the transferring efficiency is lowered whether the image is transferred onto the paper or directly onto the transfer belt. Especially when a plurality of photoconductive drums are provided to obtain a multiple-color image, the transferring efficiency varying by color results in a drastic decline of the image quality.

If the tension of the transfer belt is smaller than the desirable level, the belt slips on the driving roller for driving the belt, whereby the belt cannot travel around smoothly, resulting in malfunctions like transfer error. If the tension of the belt is larger than the desirable level, on the other hand, the belt is given excessive load and its life is shortened.

2) A solution of the above problem is adjusting the pressure-contacting force and the tension of the belt without separating the belt from the drum. This method is not practical since it makes the adjustment itself quite difficult and troublesome and requires high technique.

3) Since the pressure-contacting roller is moved in a direction to press up the transfer belt during adjustment, the transfer belt is given higher tension than in use, whereby being worn rapidly.

4) Since the adjustment is done at four points, it is time-consuming and requires a lot of steps.

SUMMARY OF THE INVENTION

Accordingly, it is a primary object of this invention to offer an image forming device having an advanced construction for supporting a transfer belt.

It is a secondary object of this invention to offer an image forming device for adjusting the pressure-contacting force of a transfer belt against a toner carrier and the tension of the transfer belt efficiently and accurately in order to improve the transferring efficiency, resulting in obtaining a clear image.

The above objects are fulfilled by an image forming device for pressure-contacting an endless belt on an image carrier for the purpose of image transferring, the device comprising a rotating image carrier for carrying an image; a transfer unit including a plurality of rotating rollers, an endless belt travelling around the rollers, and a supporting member for supporting the rollers in such a manner that distances between the rollers be kept constant, at least one of the rollers being a pressure-contacting roller opposed to the image carrier with the endless belt therebetween; and pressure-contacting means for energizing the transfer unit in a direction that the pressure-contacting roller be pressure-contacted on the image carrier with the endless belt therebetween.

The supporting member may include tension adjusting means for adjusting a tension of the transfer belt.

The above objects are also fulfilled by an image forming device comprising a plurality of rollers including a pressure-contacting roller; an endless belt supported and tensed by the rollers; an image carrier opposed to the pressure-contacting roller with the endless belt therebetween; a framing member for supporting both ends of the rollers so that the rollers be rotatable and keep specified distances from one another, the distances being constant even if the framing member and the image carrier are relatively moved; a guiding member for supporting the framing member so that the framing member be movable in a direction that the pressure-contacting roller be separated from the image carrier; pressure-contacting means for energizing the framing member in a direction that the pressure-contacting roller approach the image carrier; and transferring means for transferring an image formed on the image carrier onto a transferring medium.

The above device may further comprise another image carrier and another pressure-contacting roller opposed to the above another image carrier, wherein the guiding member swingably supports the framing member and the pressure-contacting means presses the framing member between the two pressure-contacting rollers.

The guiding member may support a position of the framing member equally distanced from the two pressure-contacting rollers and the pressure-contacting means presses a swinging axis of the framing member in a direction that the two pressure-contacting rollers approach their respective image carriers.

The above objects are also fulfilled by an image forming device comprising a first rotating image carrier; a second rotating image carrier; first image forming means for forming an image on the first image carrier; second image forming means for forming another image on the second image carrier; a plurality of supporting rollers; an endless belt supported by and travelling around the supporting rollers; a framing member for supporting the supporting rollers; supporting means for swingably supporting the framing member; pressure-contacting means for energizing a swinging axis of the framing member in a direction that the endless belt be pressure-contacted on the first and second image carriers; and transferring means for transferring images formed on the first and second image carriers onto a transferring medium.

The swinging axis may be equally distanced from the first and second image carriers.

The first and second image carriers may have the images of different colors formed thereon.

The above objects are also fulfilled by an image forming device for pressure-contacting an endless belt on an image carrier for the purpose of image transferring, the device comprising two rotating image carriers respectively for carrying images; an endless belt travelling around; two pressure-contacting rollers respectively opposed to the image carriers with the endless belt therebetween, the rollers being for pressure-contacting the endless belt on the image carriers; a framing member for supporting the two pressure-contacting rollers; supporting means for swingably supporting the framing member; and pressure-contacting means for energizing a swinging axis of the framing member in a direction that the endless belt be pressure-contacted on the image carriers.

The above objects are also fulfilled by an image forming device comprising a first rotating photoconductive drum; a second rotating photoconductive drum; first image forming means for forming a toner image on the first photoconductive drum; second image forming means for forming another toner image on the second photoconductive drum; an endless belt travelling around for transporting a paper; two pressure-contacting rollers respectively opposed to the first and second photoconductive drums with the endless belt therebetween, the rollers being for pressure-contacting the endless belt on the first and second photoconductive drums; a plurality of supporting rollers for supporting the endless belt while providing the belt with a specified tension; a framing member for supporting both ends of the two pressure-contacting rollers and of the supporting rollers so that all the rollers be rotatable and keep specified distances from one another, the specified distances being constant even if the framing member and the photoconductive drums are relatively moved; a guiding member for supporting the framing member so that the framing member be swingable around a swinging axis thereof and be movable in a direction that the endless belt be separated from the two photoconductive drums; pressure-contacting means for energizing a swinging axis of the framing member in a direction that the pressure-contacting rollers approach the two photoconductive drums; and transferring means for transferring images formed on the photoconductive drums onto a paper transported by the endless belt.

The swinging axis may be equally distanced from the two pressure-contacting rollers.

According to this invention, the tension adjusting means eases the adjustment of the tension of the belt, which leads to efficient and accurate assembly and inspection and further extends the life of the transfer belt.

Moreover, even if there are errors in size or position of the toner carriers or of the members of the belt unit, the pressure-contacting force is equally distributed to the two pressure-contacting points. In consequence, the pressure-contacting force adjustment is much more efficient and accurate than the conventional devices. This advantage leads not only to efficient assembly and inspection but to higher transferring efficiency and further to a clearer image.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings:

FIGS. 5*a*, 5*b* and 5*c* are cross sectional views of the transfer belt unit mounted in the image forming device.

DESCRIPTION OF THE PREFERRED EMBODIMENT

Figure 1:
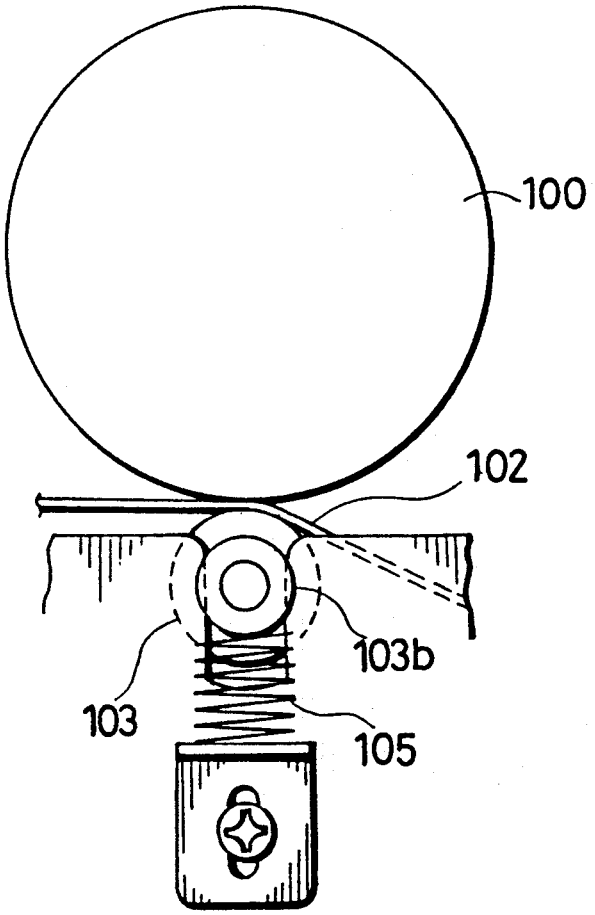
Fig. 1 Prior Art
FIG. 1 is a cross sectional view of an essential portion of a prior art material.
Figure 2:
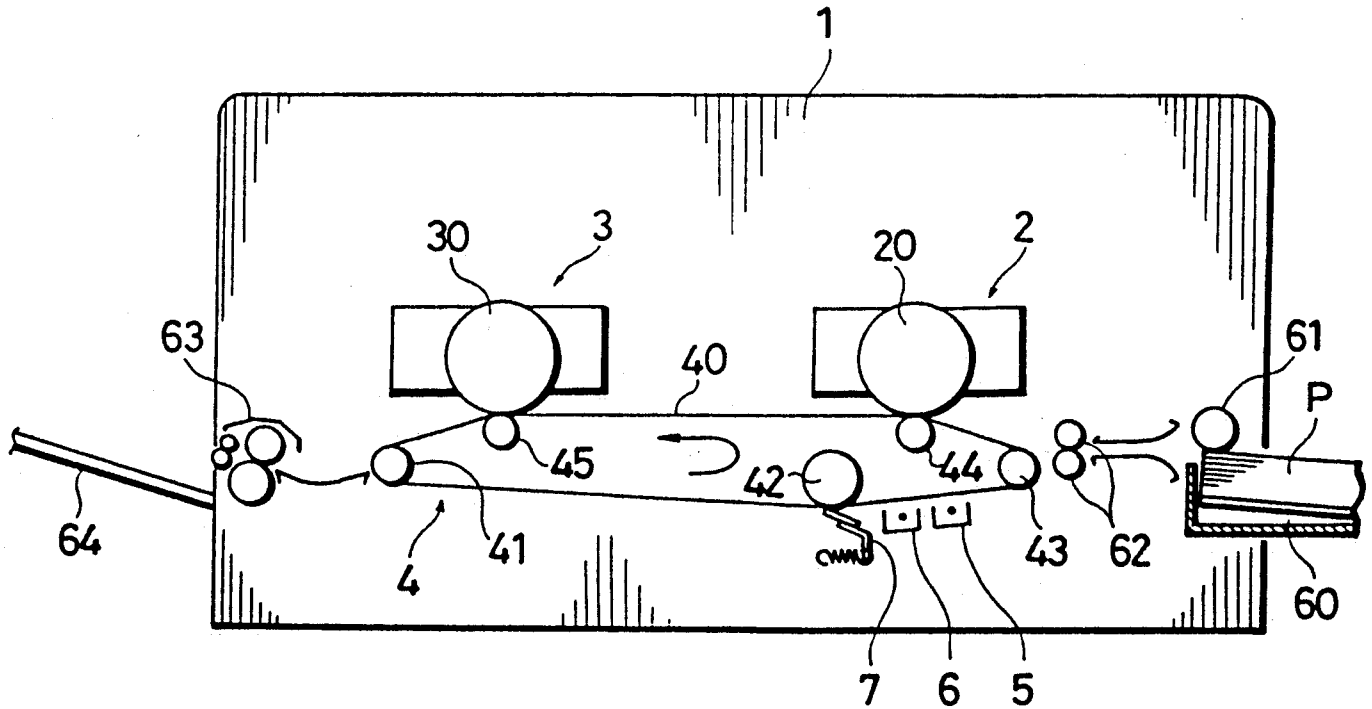
FIG. 2 is a cross sectional view of an image forming device according to the present invention.

An embodiment of this invention will be described referring to FIGS. 2 through 5. This embodiment is an image forming device for forming two-color images. As shown in FIG. 2, a main body 1 has first and second developing units 2 and 3 in right and left halves thereof for forming toner images in first and second colors, respectively. In more detail, the first and the second developing units 2 and 3 are equipped with photoconductive drums 20 and 30 and other necessary members for electrophotography, wherein optical systems (not shown) expose a document image to form electrostatic latent images on the photoconductive drums 20 and 30 and then the developing units 2 and 3 supply the photoconductive drums 20 and 30 with toners of the first and the second colors respectively to form toner images.

Disposed below the developing units 2 and 3 are an endless transfer belt 40 for transporting a paper P to below the photoconductive drums 20 and 30 and pressure-contacting the paper P on the drums 20 and 30 in order to transfer the toner images formed on the drums 20 and 30 onto the paper P so that the toner images may be superposed. The transfer belt 40 is extended in a tight loop around a driving roller 41 and four more rollers 42 through 45 and is to run in a direction of an arrow in FIG. 2.

The rollers 44 and 45 are pressure-contacted on the photoconductive drums 20 and 30 respectively for pressure-contacting the paper P on the photoconductive drums 20 and 30 for the purpose of transferring the toner images on the drums 20 and 30 onto the paper P. Hereinafter, the rollers 44 and 45 will be referred to as the pressure-contacting rollers.

The transfer belt 40 is controlled to run as fast as the photoconductive drums 20 and 30, and the transfer belt 40 and the rollers 41 through 45 are integrated as a transfer belt unit 4.

The transfer belt 40 is partially surrounded by a belt charger 5, a removing charger 6 and a cleaner 7 (from right to left in FIG. 2) below the photoconductive drum 20. The belt charger 5 is for charging the transfer belt 40 with the opposite polarity to that of the toners, and the removing charger 6 is for removing the polarity of the transfer belt 40 after the belt 40 is cleaned by the cleaner 7.

A cassette 60 is attached at the lower right of the main body 1 in FIG. 2 for accommodating a number of papers P in a stack. A feeding roller 61 is disposed at an end of the cassette 60 for feeding the papers P one by one, and a pair of timing rollers 62 are disposed to the downstream of feeding roller 61 with respect to the paper feed direction for supplying the papers P onto the transfer belt 40 by timing rotations of the photoconductive drums 20 and 30.

A fixing unit 63 is provided to the downstream of the transfer belt unit 4 with respect to the paper feed direction for fixing the image which has been transferred on the paper P, and a delivery tray 64 is disposed to the downstream of the fixing unit 63 with respect to the paper feed direction for receiving the paper P with the image fixed.

In an image forming device having the above construction, an image is transferred in the following manner.

The belt charger 5 charges the transfer belt 40 with the opposite polarity to that of the toners in the first and second developing units 2 and 3. The paper P is fed by the feeding roller 61 and the timing rollers 62, and is electrostatically adhered on and transported by the transfer belt 40 to below the photoconductive drum 20.

When the paper P is passing between the photoconductive drum 20 and the roller 44, the toner on the photoconductive drum 20 is adhered on the transfer belt 40 because the toner and the belt have opposite polarities to each other, whereby the toner image in the first color on the photoconductive drum 20 is transferred on the paper P.

Then, the paper P is carried to below the photoconductive drum 30, where the toner image in the second color on the drum 30 is transferred onto the paper P in the same manner. The paper P is separated from the transfer belt 40 when it is passing on the driving roller 41 and has the image thereon fixed by the fixing unit 63, thereafter the paper P is delivered onto the delivery tray 64.

After that, the transfer belt 40 has the toner remaining thereon scratched off by the cleaner 7 and then has its charge removed by the removing charger 6.

Figure 3:
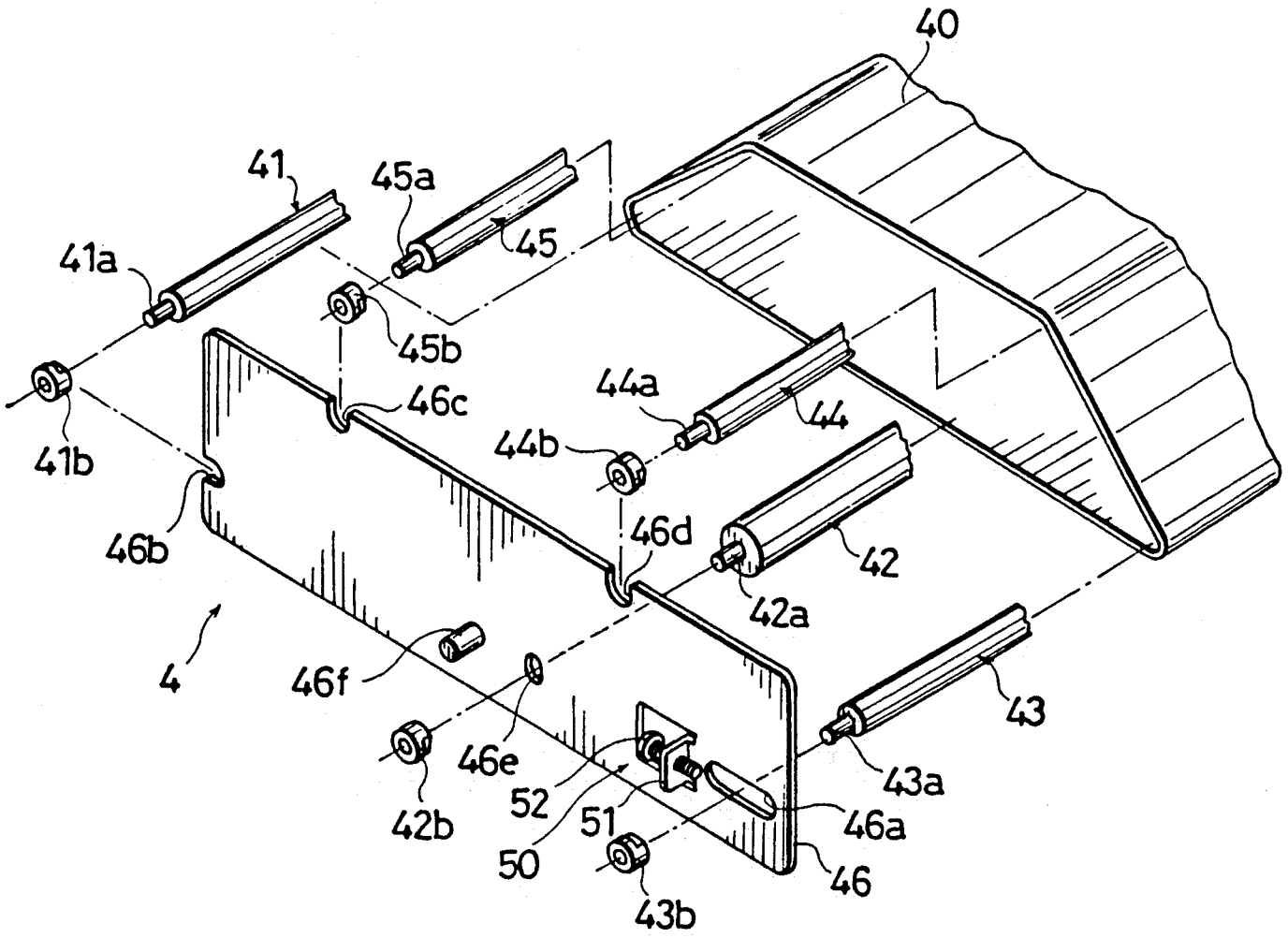
FIG. 3 is a perspective view of a transfer belt unit of the same.

The transfer belt unit 4 will be described in detail referring to FIGS. 3 and 4. In the unit 4 as shown in FIG. 3, the transfer belt 40 and the rollers 41 through 45 are disposed between a pair of opposed frames 46 (FIG. 3 shows only one of them).

One of the frames 46, which has a long rectangular shape extending horizontally, has a horizontally extended long hole **46*a* on a right end thereof. A shaft 43*a* of the roller 43 is inserted through a bearing 43*b* which is inserted through the hole 46*a*, in order that the roller 43 be rotatably attached to the frame 46. The frame 46 has a cutout 46*b* on a left end side thereof in FIG. 3. A shaft 41*a* of the roller 41 is inserted through a bearing 41*b* which is inserted through the cutout 46*b*, in order that the roller 41 be rotatably attached to the frame 46**.

The frame 46 has two more cutouts **46*c* and 46*d* on an upper end side thereof. Shafts 45*a* and 44*a* of the pressure-contacting rollers 45 and 44 are respectively inserted through bearings 45*b* and 44*b* which are inserted through the cutouts 46*c* and 46*d*, in order that the rollers 45 and 44 be rotatably attached to the frame 46. The frame 46 has still another hole 46*e* to a little right from a center thereof in FIG. 3. A shaft 42*a* of the roller 42 is inserted through a bearing 42*b* which is inserted through the hole 46*e*, in order that the roller 42 be rotatably attached to the frame 46**.

Another frame 46 has the same construction, whereby the rollers 41 through 45 are rotatably extended between these two frames 46. Since the transfer belt 40 is extended around these rollers in a loop as mentioned before, when driving means (not shown here) is driven to start rotating the driving roller 41, the rollers 42 through 45 are rotated, whereby the transfer belt 40 travels around.

Disposed to the left of the long hole **46*a* in FIG. 3 is tension adjusting means 50 for adjusting a position of the roller 43 in the hole 46*a*, namely for adjusting the relative position of the roller 43 against the driving roller 41. This adjustment is necessary for adjusting a tension of the transfer belt 40**.

The tension adjusting means 50 comprises a screw 52 inserted through a hole of a mounting member 51, which is formed by cutting a portion of the frame 46 and extruding that portion perpendicularly to the frame 46. The tension of the transfer belt 40 is determined by how far the screw 52 is inserted through the mounting member 51 to push the bearing **43*b*, namely by where the bearing 43*b* is positioned in the hole 46*a*. The other frame 46 also has another set of the tension adjusting means 50**.

In the above transfer belt unit 4, the tension of the transfer belt 40 is adjusted by the tension adjusting means provided at two positions. In such a construction, the relative positions of the rollers 41 through 45 are stable whether the transfer belt 40 is pressure-contacted on the photoconductive drums 20 and 30 or not, resulting in a stable tension of the transfer belt 40.

This means that the tension of the transfer belt 40 is adjusted just by inserting the screws 52 even when the belt 40 is not pressure-contacted with the photoconductive drums 20 or 30, which realizes efficient and accurate tension adjustment. Needless to say, since excessive tension is not applied to the transfer belt 40 during the adjustment of the pressure-contacting forces, the life of the belt 40 is extended.

Although the screw 52 is directly contacted with and pushes the bearing 43*b* in this embodiment, the screw 52 and the bearing 43*b* may have an elastic member such as a spring therebetween.

Another construction, where the bearing 43*b* is pulled to the right in FIG. 3 by a screw, is also possible.

The bearing 43*b* may be moved by a cam or the like.

Figure 4:
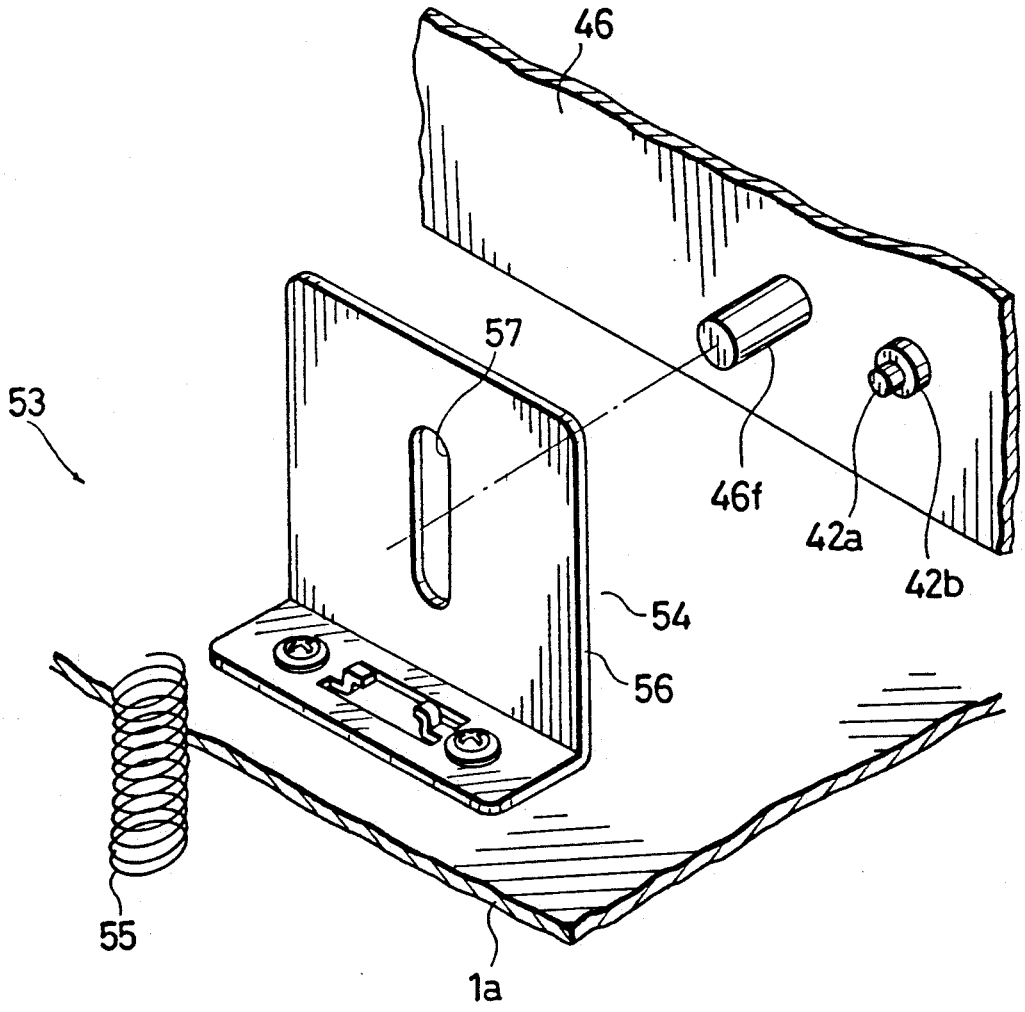
FIG. 4 is a perspective view of a construction for supporting the transfer belt unit.

As shown in FIG. 4, the transfer belt unit 4 is vertical-movably attached to the main body 1 through supporting means 53. Two supporting means 53 are opposed on a base plate 1*a* of the main body 1 with the transfer belt unit 4 therebetween. (Only one of the means 53 is shown in FIG. 4) Each supporting means 53 comprises an L-shaped member 54 for supporting the unit 4 and a spring 55 attached to the L-shaped member 54 for pressurizing the frame 46 upward. The following is the more detailed construction of the supporting means 53.

A wall 56 of the L-shaped member 54 has a vertically-extended long hole 57, through which a pin 46*f* projected from the frame 46 is inserted. An end of the pin 46*f* which is projected from the long hole 57 is to be pressurized upward by the spring 55.

In this construction, the transfer belt unit 4 is movable by the energizing force of the spring 55 by a vertical length of the long hole 57 and also is rotatable. Accordingly, pressure-contacting forces of the transfer belt 40 against the photoconductive drums 20 and 30 can automatically be set at desirable levels by adjusting the energizing forces of the springs 55 for the following reason.

The pressure-contacting forces of the springs 55 against the photoconductive drums 20 and 30 are distributed in accordance with the ratio of a distance a between the pin 46*f* and the photoconductive drum 20 and another distance between the pin 46*f* and the photoconductive drum 30, namely a:b (FIG. 5*a*). If a=b, the two pressure-contacting forces are equal. In consequence, the two pressure-contacting forces can be set equal not only in the case of FIG. 5*a* (there is no size or position error of the drums 20, 30, or the members of the belt unit 4, and the belt 40 is substantially horizontal) but in the cases of FIGS. 5*b* and 5*c* (there are size or position errors of the drums 20, 30 or the members of the belt unit 4, and the belt 40 is slightly inclined). In other words, the pressure-contacting forces $P_1$ through $P_6$ can be set $P_1=P_2$, $P_3=P_4$, and $P_5=P_6$, whether there are size or position errors of the drums 20, 30 or the members of the belt unit 4 or not.

According to this embodiment, therefore, the pressure-contacting forces can be adjusted only by adjusting the balance between the two springs 55. There is no need for considering the balance of the pressure-contacting forces of the transfer belt 40 against the drums 20 and 30. This results in an image forming device with a simple construction which realizes efficient and accurate pressure-contacting force adjustment leading to a clear image. Furthermore, since the springs 55 function as alleviators, the transfer belt 40 travelling around is not vibrated drastically. This also results in a clear image.

If the transfer belt 40 should be pressure-contacted on the drums 20 and 30 with different pressure-contacting forces, for example, if the pressure-contacting forces desired for the first and the second colors are different, a:b should be changed by attaching the two pins 46*f* at different positions on the frame 46.

Although the above embodiment is a device for transferring images onto the paper transported by the transfer belt, this invention can also be applied for a device for transferring images directly onto a transfer belt.

Even if the device has only one photoconductive drum, the tension of the transfer belt 40 can easily and accurately be adjusted.

Another construction, where the sum of the pressure-contacting forces of the transfer belt 40 against the drums 20 and 30 is adjusted by changing the forces of the springs 55 against the pins 46*f*, is also possible. In this case also, the ratio of the two pressure-contacting forces is kept the same. Since the above sum is adjusted only by changing the energizing forces of the two springs 55, the adjustment is easy.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming device comprising:

a rotating image carrier for carrying an image;

a transfer unit including a plurality of rotating rollers, an endless belt travelling around the plurality of rotating rollers, and a supporting member for supporting the plurality of rotating rollers in such a manner that the distances between the plurality of rotating rollers are kept constant, at least one of the plurality of rotating rollers being a pressure-contacting roller opposed to the rotating image carrier with the endless belt therebetween; and pressure-contacting means for energizing said transfer unit for movement in a direction to pressure-contact the pressure-contacting roller on said rotating image carrier with the endless belt therebetween to transfer the image on said rotating image carrier, wherein the supporting member includes adjusting means for adjusting the distances between the plurality of rotating rollers.

2. An image forming device comprising:

a plurality of rollers including a pressure-contacting roller;

an endless belt supported and tensed by the plurality of rollers;

an image carrier opposed to the pressure-contacting roller with said endless belt therebetween;

a framing member for supporting both ends of each of said plurality of rollers so that said plurality of rollers are rotatable and kept specified distances from one another, the specified distances being kept constant even if said framing member is moved relative to said image carrier;

a guiding member for supporting said framing member so that said framing member is movable in a direction that the pressure-contacting roller is separated from said image carrier;

pressure-contacting means for energizing said framing member in a direction that the pressure-contacting roller approaches said image carrier; and transferring means for transferring an image formed on the image carrier onto a transferring medium, wherein said image carrier comprises a first image carrier, and said pressure-contacting roller comprises a first pressure-contacting roller, and wherein said device further comprises a second image carrier and said plurality of rollers include a second pressure-contacting roller which is supported by said framing member so as to be opposed to said second image carrier with said endless belt therebetween, and wherein said guiding member swingably supports said framing member and said pressure-contacting means presses said framing member between the first and second pressure-contacting rollers.

3. A device of claim 2, wherein said guiding member supports a position of said framing member equally distanced from the first and second pressure-contacting means presses a swinging axis of said framing member in a direction that the first and second pressure-contacting rollers approach the first and second image carriers, respectively.

4. An image forming device comprising:

a first rotating image carrier;

a second rotating image carrier;

first image forming means for forming a first image on said first image carrier;

second image forming means for forming a second image on said second image carrier;

a plurality of supporting rollers;

an endless belt supported by and travelling around said plurality of supporting rollers;

a framing member for supporting said plurality of supporting rollers;

supporting means for swingably supporting said framing member;

pressure-contacting means for energizing a swinging axis of said framing member in a direction that said endless belt is pressure-contacted on said first and second image carrier; and transferring means for transferring the first and second image formed on said first and second image carrier onto a transferring medium.

5. A device of claim 4, wherein the swinging axis is equally distanced from said first and second image carrier.

6. A device of claim 5, wherein said first and second image are of different color.

7. An image forming device comprising:

two rotating image carriers respectively for carrying images;

an endless belt travelling around;

two pressure-contacting rollers respectively opposed to said two rotating image carriers with said endless belt therebetween, said two pressure-contacting rollers being for pressure-contacting said endless belt on said two rotating image carriers;

a framing member for supporting said two pressure-contacting rollers;

supporting means for swingably supporting said framing member; and pressure-contacting means for energizing a swinging axis of said framing member in a direction that said endless belt is pressure-contacted on said two rotating image carriers to transfer the images on said two rotating image carriers.

8. An image forming device comprising:

a first rotating photoconductive drum;

a second rotating photoconductive drum;

first image forming means for forming a first toner image on said first rotating photoconductive drum;

second image forming means for forming a second toner image on said second rotating photoconductive drum;

an endless belt travelling around for transporting a paper;

first and second pressure-contacting rollers respectively opposed to said first and second rotating photoconductive drums with said endless belt therebetween, said first and second pressure-contacting rollers being for pressure-contacting said endless belt on said first and second rotating photoconductive drums;

a plurality of supporting rollers for supporting said endless belt while providing said endless belt with a specified tension;

a framing member for supporting both ends of said first and second pressure-contacting rollers and of said supporting rollers so that all of said rollers are rotatable and keep specified distances from one another, the specified distances being kept constant even if said framing member is moved relative to said first and second rotating photoconductive drums;

a guiding member for supporting said framing member so that said framing member is swingable around a swinging axis thereof and is movable in a direction that said endless belt is separated from said first and second rotating photoconductive drums;

pressure-contacting means for energizing a swinging axis of said framing member in a direction that said first and second pressure-contacting rollers approach said first and second rotating photoconductive drums; and transferring means for transferring images formed on said first and second rotating photoconductive drums onto the paper transported by said endless belt.

9. A device of claim 8, wherein the swinging axis is equally distanced from said first and second pressure-contacting rollers.

10. A device of claim 1, further comprising means for cancelling pressure-contacting by said pressure-contacting means.

11. An image forming device comprising:

two or more rotating image carriers for carrying images;

a transfer unit including a plurality of rotating rollers, an endless belt travelling around the plurality of rotating rollers, and a supporting member for supporting the plurality of rotating rollers in such a manner that distances between the plurality of rotating rollers are kept constant, the plurality of rotating rollers including two or more pressure-contacting rollers which are opposed to the two or more rotating image carriers, respectively, with the endless belt therebetween; and pressure-contacting means for energizing said transfer unit for movement in a direction to pressure-contact the pressure-contacting rollers on said rotating image carriers with the endless belt therebetween to transfer the images on said rotating image carriers.

12. A device of claim 11, further comprising means for forming first color toner images on one of the two or more rotating image carriers and means for forming second color toner images which are different in color from the first color toner images on another of the two or more rotating image carriers.

13. An image forming device comprising:

a plurality of rollers including a pressure-contacting roller;

an endless belt supported and tensed by the plurality of rollers;

an image carrier opposed to the pressure-contacting roller with said endless belt therebetween;

a framing member for supporting both ends of each of said plurality of rollers so that said plurality of rollers are rotatable and keep specified distances from one another, the specified distances being kept constant even if said framing member is moved relative to said image carrier;

a guiding member for supporting said framing member so that said framing member is movable in a direction that the pressure-contacting roller is separated from said image carrier;

pressure-contacting means for energizing said framing member in a direction that the pressure-contacting roller approaches said image carrier;

transferring means for transferring an image formed on the image carrier onto a transferring medium; and adjusting means for adjusting a distance between at least one of said plurality of rollers and another of said plurality of rollers.

14. An image forming device comprising:

a plurality of rollers including a plurality of pressure-contacting rollers;

an endless belt supported and tensed by the plurality of rollers;

a plurality of image carriers opposed to the plurality of pressure-contacting rollers, said plurality of pressure-contacting rollers being respectively pressure-contacted on said plurality of image carriers with said endless belt therebetween;

a framing member for supporting both ends of each of said plurality of rollers so that said plurality of rollers are rotatable and keep specified distances from one another, the specified distances being kept constant even if said framing member is moved relative to said image carrier;

a guiding member for supporting said framing member so that said framing member is movable in a direction that the pressure-contacting rollers are separated from that image carriers;

pressure-contacting means for energizing said framing member in a direction that the pressure-contacting rollers approach said image carriers; and transferring means for transferring images formed on the image carriers onto a transferring medium.

* * * * *

UNITED STATES PATENT AND TRADEMARK OFFICE

CERTIFICATE OF CORRECTION

PATENT NO. : 5,172,175

DATED : December 15, 1992

INVENTOR(S) : Hitoshi Sekino, et al.

It is certified that error appears in the above-identified patent and that said Letters Patent is hereby corrected as shown below:

In Col. 8, line 40 (Claim 1, line 7), delete "the" (first occurrence).

In Col. 8, line 63 (Claim 2, line 10), change "kept" to --keep--.

In Col. 9, line 23 (Claim 3, line 3), after "pressure-contacting", insert --rollers and said pressure-contacting--.

In Col. 12, line 26 (Claim 14, line 20), change "that" to --said--.

Signed and Sealed this

Second Day of November, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,172,175

DATED : December 15, 1992

INVENTOR(S) : Hitoshi Sekino, et al

It is certified that error appears in the above-indentified patent and that said Letters Patent is hereby corrected as shown below:

In the drawings Sheet 5 of 5 delete the unnumbered Fig. thereon and insert the following Fig. 5a, 5b and 5c, as shown on the attached page.

Signed and Sealed this

Twenty-first Day of December, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,172,175

DATED : December 15, 1992

INVENTOR(S) : Hitoshi Sekino, et. al.

It is certified that error appears in the above-indentified patent and that said Letters Patent is hereby corrected as shown below:

Fig. 5a

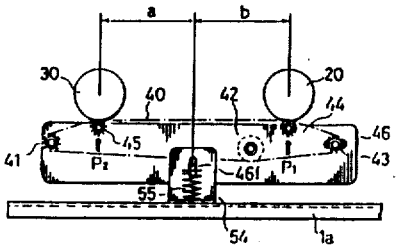

Fig. 5b

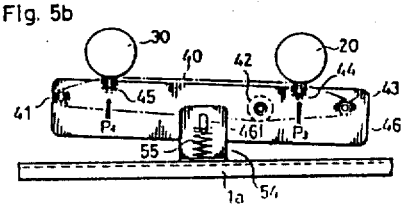

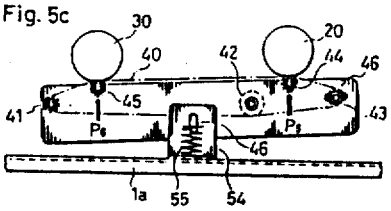

Fig. 5c